US011630422B2

(12) United States Patent
Tschumi

(10) Patent No.: US 11,630,422 B2
(45) Date of Patent: Apr. 18, 2023

(54) SUB-ASSEMBLY OF EXTERNAL PARTS FOR TIMEPIECE OR WATCH OR A PIECE OF JEWELLERY

(71) Applicant: The Swatch Group Research and Development Ltd, Marin (CH)

(72) Inventor: Philipp Tschumi, Niederwil (CH)

(73) Assignee: The Swatch Group Research and Development Ltd, Marin (CH)

( * ) Notice: Subject to any disclaimer, the term of this patent is extended or adjusted under 35 U.S.C. 154(b) by 406 days.

(21) Appl. No.: 16/919,435

(22) Filed: Jul. 2, 2020

(65) Prior Publication Data

US 2021/0088974 A1 Mar. 25, 2021

(30) Foreign Application Priority Data

Sep. 20, 2019 (EP) ..... 19198512

(51) Int. Cl.
*G04B 37/00* (2006.01)
*G04B 37/08* (2006.01)
(Continued)

(52) U.S. Cl.
CPC ..... *G04B 37/0041* (2013.01); *G04B 37/005* (2013.01); *G04B 37/08* (2013.01); *A44C 25/00* (2013.01); *A44C 27/00* (2013.01)

(58) Field of Classification Search
CPC .. G04B 37/0041; G04B 37/005; G04B 37/08; G04B 37/11; G04B 19/283;
(Continued)

(56) References Cited

U.S. PATENT DOCUMENTS 3,517,501 A * 6/1970 Klingenberg ..... G04B 3/043 968/32
3,817,026 A * 6/1974 Lopez ..... G04B 37/0016 968/296
(Continued)

FOREIGN PATENT DOCUMENTS

CH 710 451 A1 6/2016
CH 710 451 B1 6/2016
(Continued)

OTHER PUBLICATIONS

Japanese Office Action dated Jul. 27, 2021 in Japanese Patent Application No. 2020-133685 (with English translation), 8 pages.
(Continued)

*Primary Examiner* — Edwin A. Leon
(74) *Attorney, Agent, or Firm* — Oblon, McClelland, Maier & Neustadt, L.L.P.

(57) ABSTRACT

A sub-assembly of external parts including, coaxially with a first component and a second component compressing together a sealing and friction joint, and interposed therebetween, a bolt securing them together by axially blocking the first component, and a lower surface of which lies, in the assembled position, in the vicinity of an upper surface of the second component, which bolt includes a lower relief protruding axially from this lower surface towards the second component, arranged to either complementarily cooperate with an oblong groove which is partially of revolution that the upper surface includes, and interrupted by a stopper limiting the angular travel between the second component and the bolt within a turn, or else to constitute an angular stopper to an upper relief protruding from the upper surface of the second component and extending axially towards the bolt.

22 Claims, 2 Drawing Sheets

(51) Int. Cl.
*A44C 25/00* (2006.01)
*A44C 27/00* (2006.01)

(58) Field of Classification Search
CPC .... G04B 37/106; G04B 37/087; A44C 25/00; A44C 27/00; A44C 5/147
See application file for complete search history.

(56) References Cited

U.S. PATENT DOCUMENTS

| | | | | |
|---|---|---|---|---|
| 7,572,049 | B2 * | 8/2009 | Hiranuma ..... | G04B 19/286 368/295 |
| 7,942,574 | B2 * | 5/2011 | Hozumi ..... | G04B 3/043 368/308 |
| 2001/0040840 | A1 | 11/2001 | Terasawa et al. | |
| 2003/0016591 | A1 | 1/2003 | Meyrat et al. | |
| 2003/0210614 | A1 | 11/2003 | Cooper et al. | |
| 2008/0225650 | A1 | 9/2008 | Muller et al. | |
| 2014/0313870 | A1 | 10/2014 | Bolzt et al. | |
| 2018/0032033 | A1 | 2/2018 | Mollier et al. | |

FOREIGN PATENT DOCUMENTS

| | | | |
|---|---|---|---|
| CN | 101299144 | A | 11/2008 |
| CN | 102819214 | A | 12/2012 |
| EP | 1 278 108 | A1 | 1/2003 |
| EP | 1 278 108 | B1 | 1/2003 |
| EP | 1 760 556 | A1 | 3/2007 |
| EP | 3 276 187 | A1 | 1/2018 |
| FR | 2201496 | | 5/1974 |

OTHER PUBLICATIONS

Combined Chinese Office Action and Search Report dated Jul. 14, 2021 in Patent Application No. 202010908636.1 (with English language translation and English translation of Category of Cited Documents), citing documents AA-AC and AO-AQ therein, 10 pages.

European Search Report dated Mar. 25, 2020 in European Application 19198512.6 filed Sep. 20, 2019 (with English Translation of Categories of Cited Documents), citing documents AA-AC & AO-AR therein, 7 pages.

* cited by examiner

SUB-ASSEMBLY OF EXTERNAL PARTS FOR TIMEPIECE OR WATCH OR A PIECE OF JEWELLERY

CROSS-REFERENCE TO RELATED APPLICATION

This application claims priority to European Patent Application No. 19198512.6 filed on Sep. 20, 2019, the entire disclosure of which is hereby incorporated herein by reference.

FIELD OF THE INVENTION

The invention relates to a sub-assembly of external parts for a timepiece or watch or for a piece of jewellery, including, coaxially with a first component and a second component, compressing together a sealing and friction joint, and interposed therebetween, a bolt securing them together by axially blocking said first component, and a lower surface of which lies, in the assembled position, in the vicinity of an upper surface of said second component.

The invention also relates to a timepiece, in particular a watch, including such a sub-assembly of external parts.

The invention also relates to a piece of jewellery including such a sub-assembly of external parts.

The invention also relates to a method for assembling such a sub-assembly of external parts.

The invention relates to the field of external parts of watches, and the field of jewellery.

BACKGROUND OF THE INVENTION

The external parts of watches and similar apparatuses obeys many constraints, particularly sealing, robustness, appearance constraints, and must be carried out in such a way as to prevent any unintentional dismounting resulting irreparably in an after-sales intervention for joint exchange, cleaning, lubrication, even repair.

Some external part or control components must also be angularly indexed relative to one another, for origin reference position, rest, or actuation location, or else to facilitate the reading of indications or graduations, or to ensure the continuity of left surfaces and/or decorations. This angular indexing is often difficult to achieve well, in combination with a good gripping of the components and with a perfect water-resistance of the joints.

SUMMARY OF THE INVENTION

The invention intends to produce a water-resistant and secure assembly of external part components with an easy-to-adjust angular indexing.

To this end, the invention relates to a sub-assembly of external parts for a timepiece or for a piece of jewellery according to claim 1.

The invention also relates to a timepiece, in particular a watch, including such a sub-assembly of external parts.

The invention also relates to a piece of jewellery including such a sub-assembly of external parts.

The invention also relates to a method for assembling such a sub-assembly of external parts.

BRIEF DESCRIPTION OF THE DRAWINGS

Other features and advantages of the invention will appear upon reading the detailed description that follows, with reference to the appended drawings, where.

DETAILED DESCRIPTION OF PREFERRED EMBODIMENTS

Figure 1:
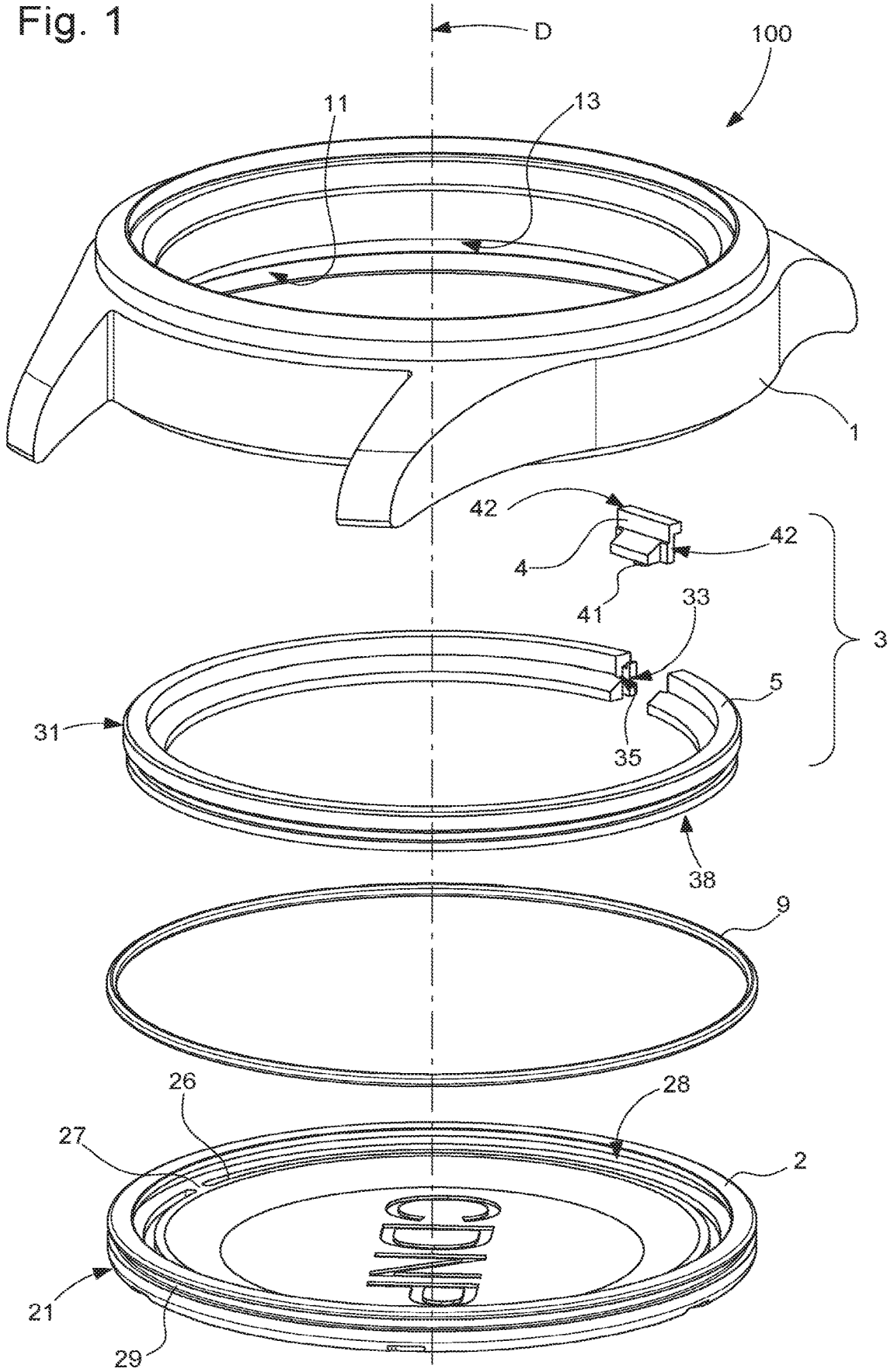
FIG. 1 schematically shows, in exploded perspective, a particular variant of a sub-assembly of external parts according to the invention, including a first component which is a middle part, under which is shown a second component which is a back, and a bolt which is an elastic split ring, including an insert, which bolt is intended to be inserted between the first component and the second component, the latter trapping therebetween a sealing and friction joint.
Figure 2:
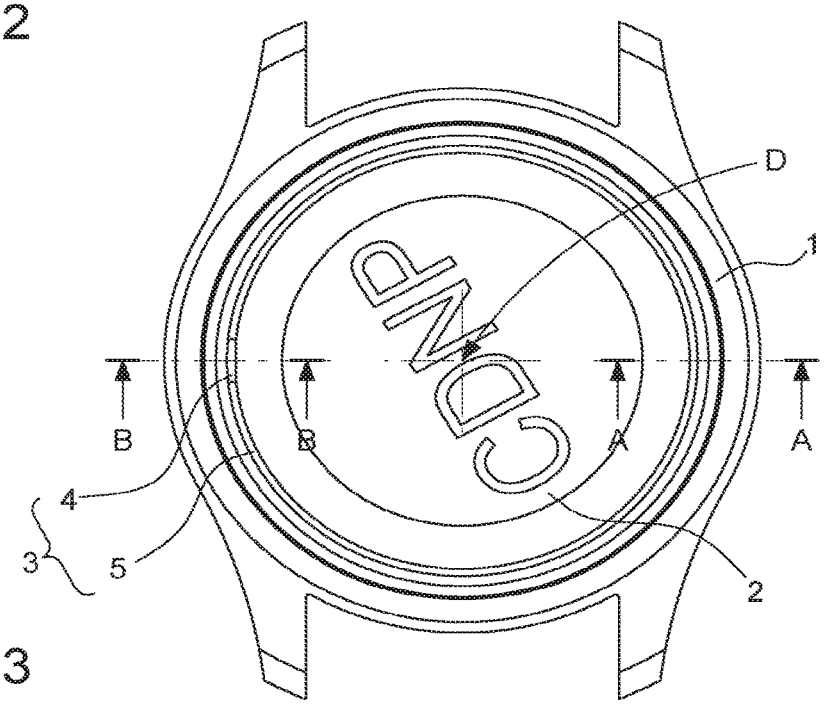
FIG. 2 shows, in top view, the sub-assembly of FIG. 1 in the assembled position.
Figure 3:
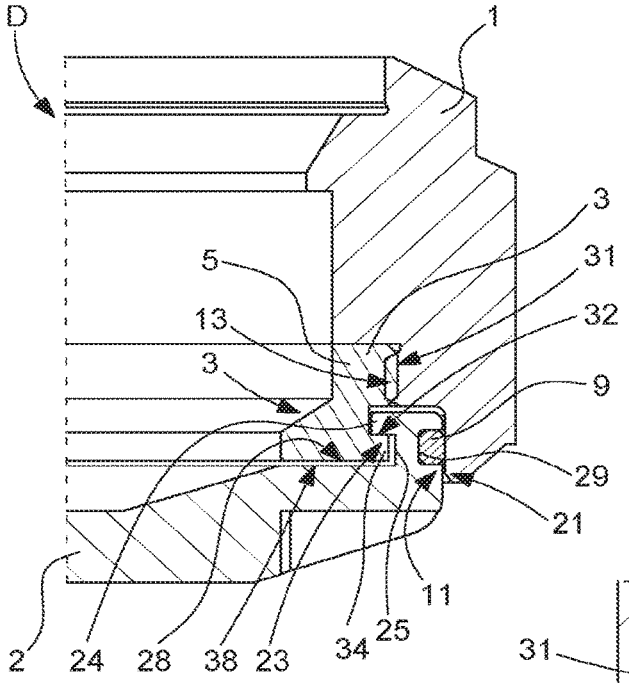
FIG. 3 is a cross section along the section plane AA of FIG. 2.
Figure 4:
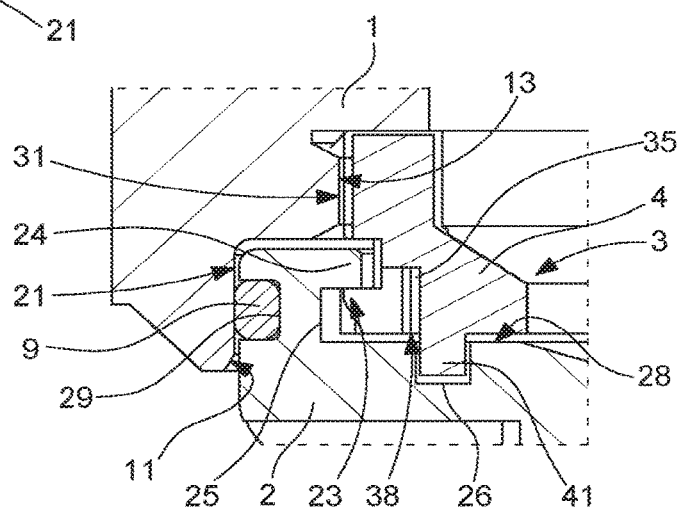
FIG. 4 is a cross section along the section plane BB of FIG. 2, passing through the insert.

The invention intends to produce a water-resistant and secure assembly of external part components with an easy-to-adjust angular indexing, and in a guaranteed position, with a minimum number of components, and moderate manufacturing costs.

The figures illustrate the non-limiting example of the angular indexing of a back relative to a watch middle part.

The invention relates to a sub-assembly of external parts 100 for a timepiece, in particular for a watch, or for a piece of jewellery, including a bolt 3, mounted coaxially with a first component 1 and a second component 2, which together compress a sealing and friction joint 9. This bolt 3 is interposed between the first component 1 and the second component 2, and secures them together by axially blocking the first component 1. A lower surface 38 of this bolt 3 lies, in the assembled position, in the vicinity of an upper surface 28 of the second component 2.

According to the invention, the bolt 3 includes a lower relief 41 protruding axially from the lower surface 38 towards the second component 2, which is arranged to either complementarily cooperate with an oblong groove 26 which is partially of revolution that the upper surface 28 includes, and interrupted by a stopper 27 limiting the angular travel between the second component 2 and the bolt 3 within a turn, or else to constitute an angular stopper to an upper relief protruding from the upper surface 28 of the second component 2 and extending axially towards the bolt 3.

Only the first alternative is illustrated by the figures.

More particularly, the sub-assembly 100 includes, substantially of revolution about the same axis D, the first component 1 and the second component 2. The first component 1 includes a first surface 11 arranged to complementarily cooperate with a second surface 21 that the second component 2 includes, so as to compress therewith at least one such sealing and friction joint 9 interposed between the first surface 11 and the second surface 21. The bolt 3 is also substantially of revolution about the axis D, and is arranged to secure the first component 1 with the second component 2 by screwing and/or elastic retention in an axial blocking position in the direction of the axis D. This bolt 3 includes, on the one hand, first fastening means 31 arranged to cooperate with first complementary fastening means 13 that the first component 1 includes, and on the other hand, second fastening or support means 32 arranged to cooperate with second complementary fastening or support means 23 that the second component 2 includes.

More particularly, the bolt 3 includes locating means arranged to cooperate with complementary locating means that the second component 2 includes, to determine their relative angular indexing position.

More particularly, the bolt 3 includes a ring 5 including this at least one lower relief 41.

More particularly, the bolt 3 includes a split ring 5 which is arranged to receive, on only part of its periphery, at least one removable insert 4 which includes a lower relief 41.

More particularly, this at least one removable insert 4 is insertable and extractable in the direction of the axis D. And the ring 5 advantageously includes, on either side of a slot that it includes, a housing 35, or respectively a post, arranged to complementarily cooperate with a post 42, or respectively a housing, that such a removable insert 4 includes for its radial retention relative to the axis D.

More particularly, the ring 5 is an elastic split ring.

More particularly, the first fastening means 31 are constituted by a threading, which is arranged to cooperate with a tapping constituting the first complementary fastening means 13.

More particularly, the ring 5 includes the threading 31, and the removable insert 4 has no threading.

More particularly, the second fastening or support means 32 are constituted by an upper surface that a lower collar 34 includes, that the bolt 3 includes, and the second complementary fastening or support means 23 are constituted by a lower surface that an upper collar 24 includes that the second component 4 includes.

More particularly, the lower collar 34 and/or the upper collar 24 is elastic.

More particularly, at least one sealing and friction joint 9 is housed in a joint groove 29 that the second component 2 or the first component 1 includes, and which, more particularly, constitutes a recess of the second surface 21.

More particularly, the first component 1 is a middle part and the second component 2 is a back.

More particularly, the first component 1 is a middle part and the second component 2 is a flange or a bezel.

More particularly, the first component 1 is a middle part or a tube attached to a middle part, and the second component 2 is a crown or a crown rod or a push-piece.

More particularly, the bolt 3 includes at least one elastic element which is arranged to constitute means of radial repulsion tending to press the first component 1 and the second component 2 on each other.

The invention also relates to a watch 1000 including such a sub-assembly of external parts 100.

The invention also relates to a piece of jewellery including such a sub-assembly of external parts 100.

The invention also relates to a method for assembling such a sub-assembly of external parts 100.

More particularly, according to this method:

the elastic split ring 5 is inserted into the second component 2, each removable insert 4 that the bolt 3 includes is inserted into the ring 5, the at least one sealing and friction joint 9 is positioned between the second component 2 and the first component 1, the bolt 3 and the first component 1 are screwed together, first of all by driving the second component 2 relative to the bolt 3 until a lower relief 41 reaches a first stop position at a first end of the angular travel, then by performing the complete screwing at the recommended torque between the bolt 3 and the first component 1, then the second component 2 is angularly oriented relative to the first component 1 by driving it in the direction opposite to the direction of screwing to the desired position.

More particularly, in order to proceed with the dismounting of the sub-assembly of external parts 100, the second component 2 is continued to be driven in the direction opposite to the screwing direction until a lower relief reaches a second stop position at the other end of the angular travel, allowing the bolt 3 to be driven in order to unscrew it from the first component 1.

The invention allows ensuring the perfect orientation of a component kept blocked in its service position.

The invention also allows cooperating antagonistic components made of materials of different natures, without stress of expansion friction, elasticity, or the like, without requiring an external fastening element such as screws or the like, without a screw thread nor machining liable to weaken particular materials such as ceramics, sapphire, and the like. It has a very good resistance to accidental or even voluntary unscrewing by vibration or of the Chapuis-choc type. The invention also allows ensuring the interchangeability of the components, and, consequently, an increased personalisation of the watches or the pieces of jewellery of the users.

This invention is applicable both to watches or pieces of jewellery made of precious materials and to mass-produced products including components of low unit cost, in particular made of plastic material or the like.

The invention is well suited in the cases where the sub-assembly 100 includes components made of different materials, with different expansion coefficients, or else fragile or hard materials (ceramic, sapphire, precious stones, gems, cameos), which do not allow standard fastening modes. Among conventional configurations mention can be made of assembling a gold middle part with a sapphire back, or an entirely ceramic case, a metal-ceramic combination, or the like. The components can thus be made of all kinds of materials: metal alloys, in particular precious or titrated metal alloys, stainless steels, at least partially amorphous metal alloys, or "Liquidmetal ©" or the like, ceramics, sapphire, minerals, hard stones, rubber, plastic materials and in particular thermoplastic elastomers called TPE including in particular thermoplastic polyurethane called TPU, polycarbonates called PC, polyvinyl chlorides called PVC, polyacetals or polyoxymethylene called POM, silicone, "Nylon®", to name, in a non-limiting manner, only materials which are common in watchmaking and jewellery.

The invention claimed is:

1. A sub-assembly of external parts for a watch or for a piece of jewellery, comprising, coaxially with a first component and a second component compressing together a sealing and friction joint, and interposed therebetween, a bolt securing them together by axially blocking said first component, and a lower surface of said bolt faces, in the assembled position, an upper surface of said second component, wherein said bolt includes a lower relief protruding axially from said lower surface towards said second component, wherein said lower relief is arranged to either complementarily cooperate with an oblong groove which is partially of revolution that said upper surface includes, and interrupted by a stopper limiting the angular travel between said second component and said bolt within a turn, or to constitute an angular stopper to an upper relief protruding from said on upper face of said second component and extending axially towards said bolt.

2. The sub-assembly of external parts according to claim 1, wherein said sub-assembly comprises, substantially of revolution about the same axis, said first component and said second component, said first component including a first surface arranged to complementarily cooperate with a second surface that said second component includes so as to compress therewith at least one said sealing and friction joint interposed between said first surface and said second surface, wherein said bolt is also substantially of revolution about said axis, and is arranged to secure said first component with said second component by screwing and/or elastic retention in an axial blocking position in the direction of said axis, said bolt including, on the one hand, first fastening means arranged to cooperate with first complementary fastening means that said first component includes, and on the other hand, second fastening or support means arranged to cooperate with second complementary fastening or support means that said second component includes.

3. The sub-assembly of external parts according to claim 1, wherein said bolt comprises locating means arranged to cooperate with complementary locating means that said second component includes to determine their relative angular indexing position.

4. The sub-assembly of external parts according to claim 1, wherein said bolt comprises a ring including said at least one lower relief.

5. The sub-assembly of external parts according to claim 1, wherein said bolt comprises a split ring arranged to receive, on only part of its periphery, at least one removable insert which includes a said lower relief.

6. The sub-assembly of external parts according to claim 5, wherein said at least one removable insert is insertable and extractable in the direction of said axis, wherein said ring comprises, on either side of a slot that it includes, a housing, or respectively a post, arranged to complementarily cooperate with a post, or respectively a housing, that a said removable insert includes for its radial retention relative to said axis.

7. The sub-assembly of external parts according to claim 4, wherein said ring is an elastic split ring.

8. The sub-assembly of external parts according to claim 2, wherein said first fastening means are constituted by a threading arranged to cooperate with a tapping constituting said first complementary fastening means.

9. The sub-assembly of external parts according to claim 8, wherein said ring comprises said threading, and wherein said removable insert has no threading.

10. The sub-assembly of external parts according to claim 2, wherein said second fastening or support means are constituted by an upper surface that a lower collar comprises that said bolt includes, and wherein said second complementary fastening or support means are constituted by a lower surface that an upper collar includes that said second component includes.

11. The sub-assembly of external parts according to claim 10, wherein said lower collar and/or said upper collar is elastic.

12. The sub-assembly of external parts according to claim 1, wherein at least one said sealing and friction joint is housed in a joint groove that said second component or said first component includes.

13. The sub-assembly of external parts according to claim 1, wherein said first component is a middle part and said second component is a back.

14. The sub-assembly of external parts according to claim 1, wherein said first component is a middle part and said second component is a flange or a bezel.

15. The sub-assembly of external parts according to claim 1, wherein said first component is a middle part or a tube attached to a middle part, and said second component is a crown or a crown rod or a push-piece.

16. The subassembly of external parts according to claim 1, wherein said bolt comprises at least one elastic element arranged to constitute means of radial repulsion tending to press said first component and said second component on each other.

17. A watch comprising the sub-assembly of external parts according to claim 1.

18. A piece of jewellery comprising the sub-assembly of external parts according to claim 1.

19. A method for assembling the sub-assembly of external parts according to claim 5, wherein said elastic split ring is inserted into said second component, wherein each said removable insert that said bolt includes is inserted into said ring, wherein said at least one sealing and friction joint is positioned between said second component and said first component, and that said bolt and said first component are screwed together, first of all by driving said second component relative to said bolt until said lower relief reaches a first stop position at a first end of said angular travel, then by performing the complete screwing at the recommended torque between said bolt and said first component, wherein said second component is angularly oriented relative to said first component by driving it in the direction opposite to the direction of screwing to the desired position.

20. The assembly method according to claim 19, wherein, in order to proceed with the dismounting of said sub-assembly of external parts, the second component is continued to be driven in the direction opposite to the screwing direction until a said lower relief reaches a second stop position at the other end of said angular travel, allowing said bolt to be driven in order to unscrew it from said first component.

21. The subassembly of external parts according to claim 1, wherein said lower relief is arranged to complementarily cooperate with an oblong groove which is partially of revolution that said upper surface includes, and interrupted by a stopper limiting the angular travel between said second component and said bolt within a turn.

22. The subassembly of external parts according to claim 1, wherein said lower relief is arranged to constitute an angular stopper to an upper relief protruding from said on upper face of said second component and extending axially towards said bolt.

* * * * *